US008297534B2

(12) United States Patent
Li et al.

(10) Patent No.: US 8,297,534 B2
(45) Date of Patent: Oct. 30, 2012

(54) SHOWER WITH ROTATABLE TOP AND BOTTOM ROTATING COVERS

(75) Inventors: Renzhong Li, Xiamen (CN); Jianmin Chen, Xiamen (CN); Bin Chen, Xiamen (CN); Huasong Zhou, Xiamen (CN)

(73) Assignees: Xiamen Solex High-Tech Industries Co., Ltd., Xiamen (CN); Huasong Zhou, Xiamen (CN)

( * ) Notice: Subject to any disclaimer, the term of this patent is extended or adjusted under 35 U.S.C. 154(b) by 426 days.

(21) Appl. No.: 12/620,766

(22) Filed: Nov. 18, 2009

(65) Prior Publication Data

US 2011/0114753 A1 May 19, 2011

(51) Int. Cl.

| | |
|---|---|
| ***B05B 3/02*** | (2006.01) |
| ***B05B 3/10*** | (2006.01) |
| ***B05B 3/04*** | (2006.01) |
| ***B05B 1/14*** | (2006.01) |
| ***A62C 31/02*** | (2006.01) |
| ***A62C 31/00*** | (2006.01) |
| ***A62C 37/20*** | (2006.01) |

(52) U.S. Cl. ..... 239/222.11; 239/222.15; 239/222.17; 239/224; 239/240; 239/263; 239/391; 239/442; 239/449; 239/558; 239/562

(58) Field of Classification Search ..... 239/225.1, 239/237, 240, 263, 391, 548, 558, 559, 567, 239/562, 563, 222.11–224, 442–449
See application file for complete search history.

(56) References Cited

U.S. PATENT DOCUMENTS

| | | | | | |
|---|---|---|---|---|---|
| 1,289,779 | A | * | 12/1918 | Howard | 239/7 |
| 1,869,384 | A | * | 8/1932 | MacLachlan | 239/224 |
| 1,962,781 | A | * | 6/1934 | MacLachlan | 239/224 |
| 2,163,474 | A | * | 6/1939 | Sloan | 261/30 |
| 2,276,961 | A | * | 3/1942 | Graham et al. | 239/214.13 |
| 2,512,782 | A | * | 6/1950 | Strickland | 239/77 |
| 2,607,574 | A | * | 8/1952 | Hession, Jr. | 261/90 |
| 3,008,652 | A | * | 11/1961 | McLean | 239/439 |
| 3,570,506 | A | * | 3/1971 | Reifenberg | 134/183 |
| 3,749,315 | A | * | 7/1973 | Crathern | 239/224 |
| 3,834,624 | A | * | 9/1974 | Novosad et al. | 239/214.15 |
| 4,187,986 | A | * | 2/1980 | Petrovic | 239/449 |
| 4,202,496 | A | * | 5/1980 | VanderKelen et al. | 239/14.2 |
| 4,209,132 | A | * | 6/1980 | Kwan | 239/381 |
| 4,221,331 | A | * | 9/1980 | Goran, Jr. | 239/121 |
| 4,261,515 | A | * | 4/1981 | Rosenberg et al. | 239/222.17 |
| 4,330,089 | A | * | 5/1982 | Finkbeiner | 239/381 |
| 4,427,074 | A | * | 1/1984 | Wollin | 169/46 |
| 4,564,889 | A | * | 1/1986 | Bolson | 362/192 |
| 4,616,298 | A | * | 10/1986 | Bolson | 362/192 |
| 4,841,999 | A | * | 6/1989 | Danko | 134/22.1 |

(Continued)

*Primary Examiner* — Len Tran
*Assistant Examiner* — Steven M Cernoch
(74) *Attorney, Agent, or Firm* — Rabin & Berdo, P.C.

(57) ABSTRACT

A shower with rotatable top and bottom rotating covers and a rotatable watering function, comprising: a shower housing, a watering unit having a tilted hole, an impeller set beneath the tilted hole and axially located between the shower housing and the watering unit, a top rotating cover protruding on the shower housing and fixed on the top of the impeller, and a bottom rotating cover protruding under the watering unit and fixed beneath the impeller. The top and bottom rotating covers rotate with the impeller around the same axis. The bottom cover contains an off-center outlet. The water stream from the tilted hole of watering unit will strike the impeller, rotating the top and bottom rotating cover around the same axis. The off-center outlet of the bottom rotating cover then generates a rotating spray.

10 Claims, 5 Drawing Sheets

U.S. PATENT DOCUMENTS 5,033,897 A * 7/1991 Chen ..... 401/281
5,056,715 A * 10/1991 Korsmeyer ..... 239/214
5,254,108 A * 10/1993 Burrell et al. ..... 604/289
5,294,054 A * 3/1994 Benedict et al. ..... 239/222.15
5,323,968 A * 6/1994 Kingston et al. ..... 239/449
5,372,307 A * 12/1994 Sesser ..... 239/210
5,765,760 A * 6/1998 Kuo ..... 239/440
6,021,960 A * 2/2000 Kehat ..... 239/289
6,076,743 A * 6/2000 Fan ..... 239/99
6,439,472 B1 * 8/2002 Lin et al. ..... 239/18
6,715,699 B1 * 4/2004 Greenberg et al. ..... 239/394
6,719,218 B2 * 4/2004 Cool et al. ..... 239/443
6,742,718 B2 * 6/2004 Doebler et al. ..... 239/67
6,908,047 B2 * 6/2005 Saunders et al. ..... 239/225.1
7,100,845 B1 * 9/2006 Hsieh ..... 239/447
7,111,795 B2 * 9/2006 Thong ..... 239/383
7,178,746 B2 * 2/2007 Gross ..... 239/552
7,584,906 B2 * 9/2009 Lev ..... 239/382
8,066,203 B2 * 11/2011 Zhou ..... 239/443
8,066,204 B2 * 11/2011 Petrovic et al. ..... 239/447
2005/0061896 A1 * 3/2005 Luettgen et al. ..... 239/449
2006/0138253 A1 * 6/2006 Petrovic et al. ..... 239/446
2006/0144968 A1 * 7/2006 Lev ..... 239/590
2006/0226256 A1 * 10/2006 DeBoer et al. ..... 239/225.1
2007/0205309 A1 * 9/2007 Zhou ..... 239/587.1
2009/0014556 A1 * 1/2009 Gokal ..... 239/289
2009/0208333 A1 * 8/2009 Smith et al. ..... 416/5
2010/0264235 A1 * 10/2010 Mak et al. ..... 239/215
2011/0089258 A1 * 4/2011 Pun ..... 239/214.23

* cited by examiner

SHOWER WITH ROTATABLE TOP AND BOTTOM ROTATING COVERS

FIELD OF THE INVENTION

The present invention relates to the shower field, especially relates to a shower with rotatable top and bottom rotating covers which has a rotatable watering function.

BACKGROUND OF THE INVENTION

There are many kinds of showers with multiple watering functions in the present technique, for example, some showers can control the watering power and its watering area by changing the area and number of its watering hole, some are by disposing different watering chambers to obtain different watering functions. Moreover, there is a popular shower with rotatable watering function, by disposing a rotating unit inside the shower housing, the shower will have a rotatable watering function. Different rotating units will serve to different spray effects, such as strip-shaped spray, blade-shaped spray and so on. People are always chasing more unique spray effects for an improved bath experience or a better visual effect. However, in the present technique, the shower with rotatable watering function can only rotate inside the shower housing or only rotate inside the hole of the shower cover, wherein its structure is simple, its appearance and visual effects are not satisfiable enough.

SUMMARY OF THE INVENTION

The main object of the present invention is to overcome the drawbacks of the background technique wherein its shower structure is too simple, the visual effects are not satisfiable, and to provide a shower with rotatable top and bottom rotating covers which has a dramatic watering function and better visual effect.

To solve the above technical drawbacks, the present invention applies a technical solution as below: a shower with rotatable top and bottom rotating covers, comprising a shower housing, wherein it further comprising a watering unit which is disposed with a tilted hole, a impeller is set beneath said tilted hole, said impeller is axially located between said shower housing and said watering unit, a top rotating cover protruding on said shower housing and fixed on the top of said impeller, a bottom rotating cover protruding under said watering unit and fixed beneath said impeller, said top and bottom rotating covers rotate along with said impeller around a same axis, said bottom cover is disposed with an off-center outlet.

By applying the technical solutions of the present invention, the water stream would strike the impeller through the titled hole of the watering unit, then the impeller would drive the top rotating cover and bottom rotating cover to rotate around a same axis, so the water stream rotably spray from the off-center outlet of the bottom rotating cover to generate a rotating spray, in the present invention, the top and bottom rotating covers are located by the outside of the shower, they can simultaneously rotate with water stream, such a design acquires a shower with a dramatic watering function and better visual effect.

Preferably, said watering unit comprising an orientation watering plate which is fixed on said shower housing and a water division unit which is rotably connected to said shower housing, said orientation watering plate and said shower housing form a chamber, wherein an orientation watering hole is set on said chamber.

Preferably, there are two opposite orientation watering holes.

Preferably, wherein said water division unit comprising a supporting seat, a tilted member and a cover sequentially connected with each other, said supporting seat rotably supports said shower housing, said supporting seat has a first and a second water division hole which can respectively superpose said orientation watering hole when said water division unit rotates, said first water division hole forms a first water division chamber with said tilted member, said second water division hole forms a second water division chamber with said tilted member, said tilted hole is disposed on said tilted member which is inside said first water division chamber.

Preferably, there are respectively two opposite first water division holes and second water division holes.

Preferably, said tilted member and said cover constitute a first watering chamber and a second watering chamber which is respectively connected through said first and second water division chamber, an outlet hole is disposed on said cover inside said second watering chamber; said impeller is accommodated in said first watering chamber.

Preferably, said impeller comprising impeller blades and an impeller shaft, said impeller shaft has a hollow chamber between the impeller blades and said hollow chamber is through the off-center outlet of said bottom rotating cover.

Preferably, said bottom rotating cover is fixed under said impeller shaft by a cover plate.

Preferably, said top and bottom rotating covers are disposed with illuminant unit.

By applying the preferred technical solution of the present invention, when the water division unit is rotated to make the two orientation watering holes of said orientation watering plate to superpose the first water division hole, the first water division chamber will be fully filled with water, then the water stream will strike the impeller through the titled hole of the tilted member, the impeller is caused to rotate and drive the top and bottom rotating covers to rotate together, at the same time, the water stream will rotably spray from the off-center outlet of the bottom rotating cover through the hollow chambers between the impeller blades to generate rotating spray; when the water division unit is rotated to make the two orientation watering holes of said orientation watering plate to superpose the second water division hole, the second water division chamber is fully filled with water, then the water stream will flow from the second water division chamber to the first water division chamber, and flow out from the outlet hole of the cover to generate the flower watering effect.

Indicated from the above description of the present invention, the shower with rotatable top and bottom rotating covers of the present invention compared to the background technique has such advantages: it disposes the protruding top and bottom rotating covers by the top and bottom side of the impeller, so the top and bottom rotating covers can simultaneous rotate when the rotating spray is sprayed, thus acquire a shower of dramatic watering function and better visual effect.

DETAILED DESCRIPTION OF THE EMBODIMENTS

Figure 1:
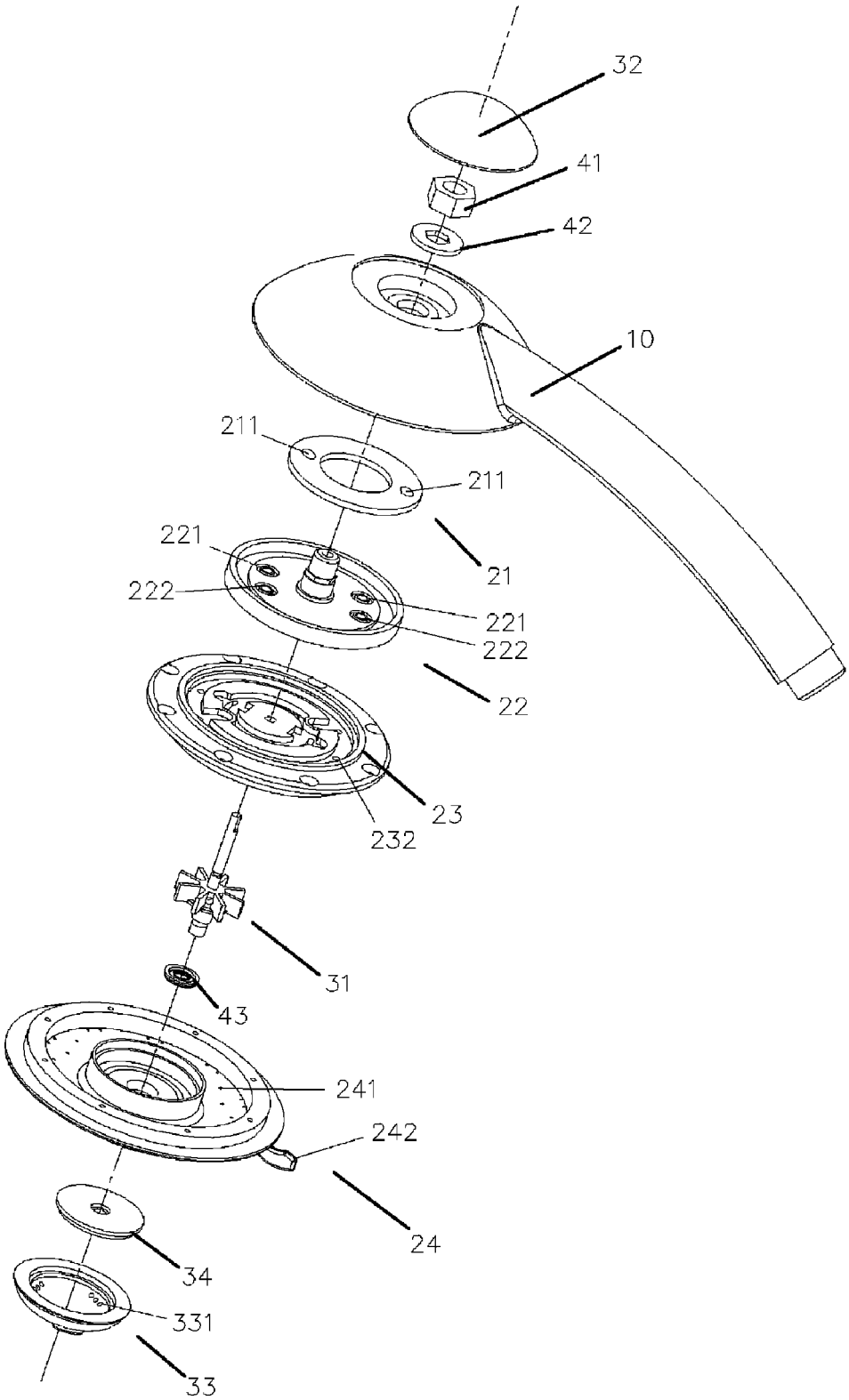
FIG. 1 illustrates the exploded view of the first embodiment of the present invention.
Figure 2:
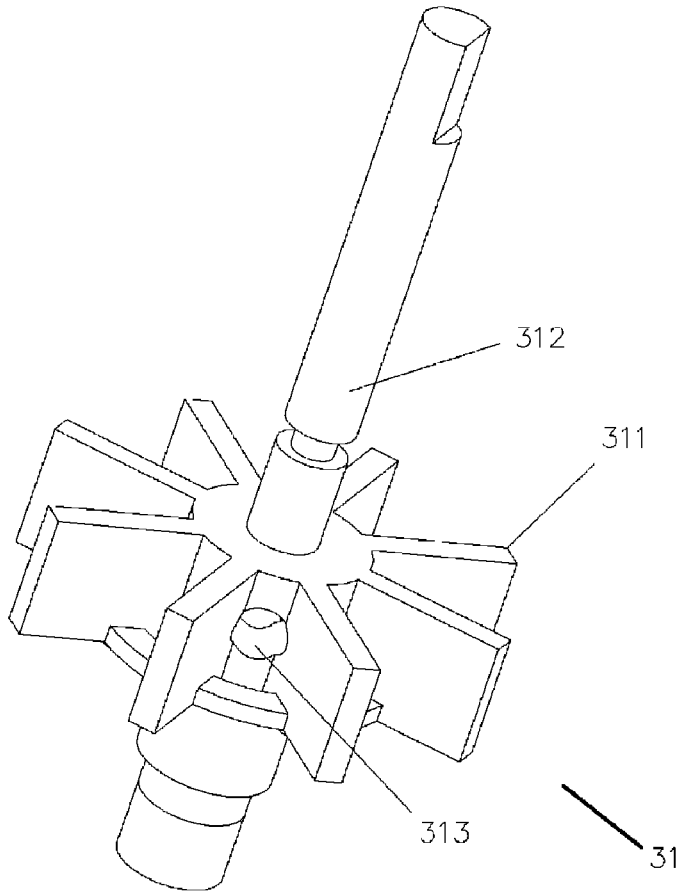
FIG. 2 illustrates the perspective view of the impeller of the first embodiment of the present invention.
Figure 3:
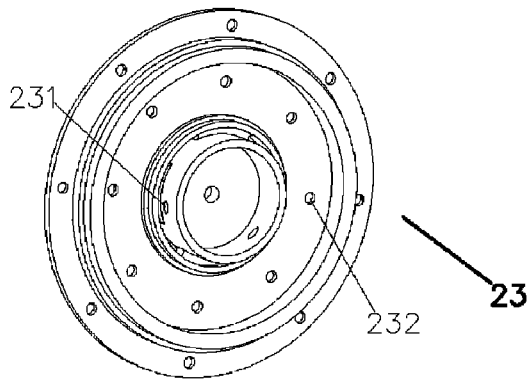
FIG. 3 illustrates the perspective view of the tilted member of the first embodiment of the present invention.
Figure 4:
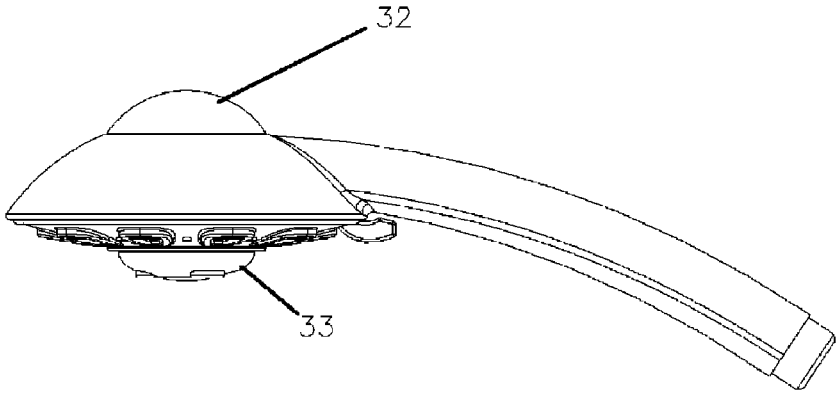
FIG. 4 illustrates the first schematic view of the assembly structure of the first embodiment of the present invention.
Figure 5:
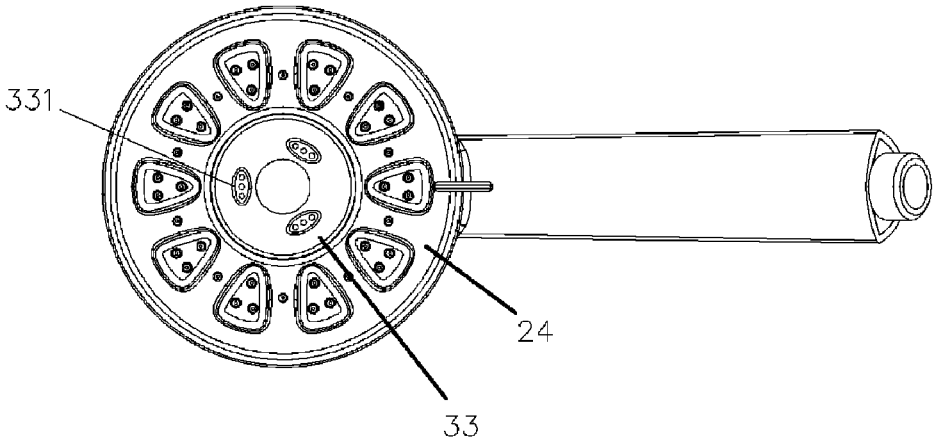
FIG. 5 illustrates the second schematic view of the assembly structure of the first embodiment of the present invention.
Figure 6:
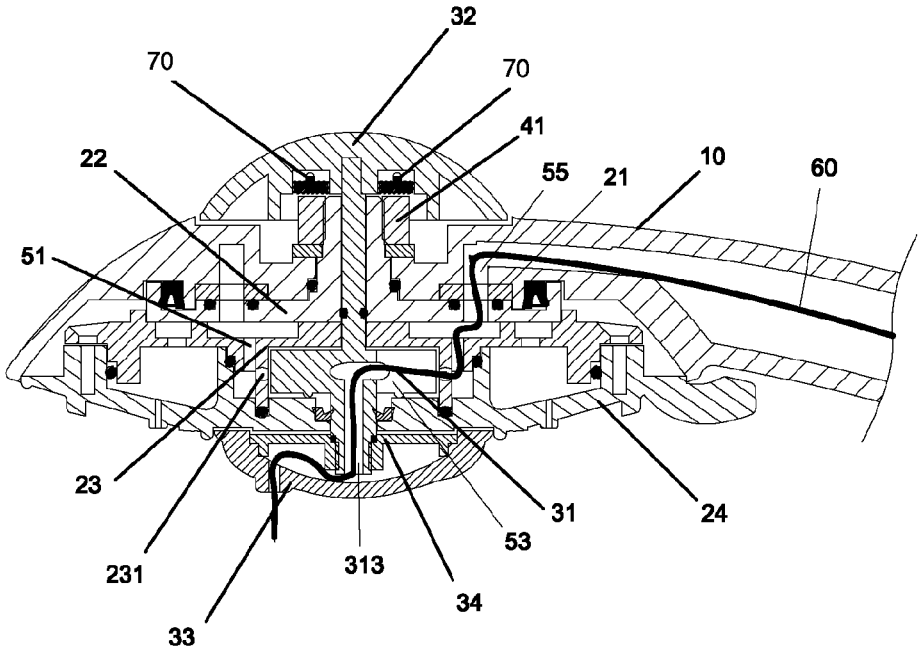
FIG. 6 illustrates the sectional view of the first embodiment of the present invention, wherein the two orientation watering holes of said orientation watering plate superpose the first water division hole.
Figure 7:
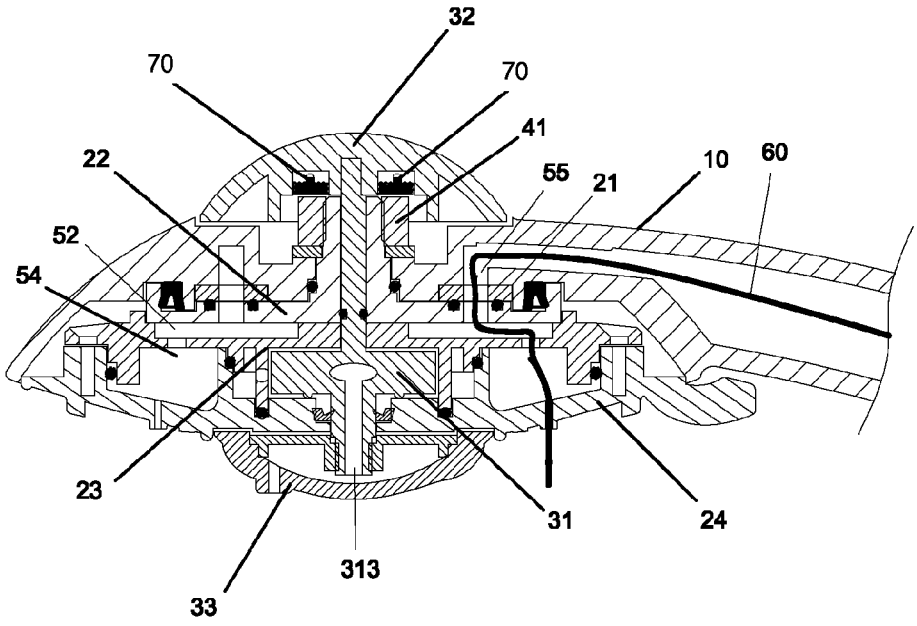
FIG. 7 illustrates the sectional view of the first embodiment of the present invention, wherein the two orientation watering holes of said orientation watering plate superpose the second water division hole.

The present invention will become apparent upon the reference of the detailed description.

First Embodiment

Please refer to FIG. 1, FIG. 2, FIG. 3, FIG. 4, FIG. 5, FIG. 6 and FIG. 7, the shower with rotatable top and bottom rotating covers of the present invention, comprising a shower housing 10, an orientation water watering plate 21, a supporting seat 22, a tilted member 23, a cover 24, a impeller 31, a top rotating cover 32, a bottom rotating cover 33, a cover plate 34, a nut 41, a isolating plate 42 and a sealing ring 43.

The supporting seat 22, tilted member 23 and cover 24 are fixed together, the supporting seat 22 is supported on said shower housing 10 by the nut 41 and isolating plate 42, so said supporting seat 22, tilted member 23 and cover 24 can simultaneously rotate around the shower housing. There are two first water division holes 221 and two second water division holes 222 disposed on said supporting seat 22, said two first water division holes 221 and two second water division holes 222 are respectively disposed oppositely, moreover, when the supporting seat 22 rotates to a certain position, the two first water division holes 221 or the two second water division holes 222 will completely superpose the two orientation watering hole 211 of said orientation watering plate 21. Said two first water division holes 221 and tilted member 23 form a first water division chamber 51, a tilted hole 231 is disposed on the tilted member 23 inside the first water division chamber 51. The orientation watering plate 21 and the housing 10 form a chamber 55. Said two second water division holes 222 and tilted member 23 form a second water division chamber 52, a watering hole 232 is disposed on the tilted member 23 inside the second water division chamber 52. The tilted member 23 and cover 24 form a first watering chamber 53 and a second watering chamber 54 which is respectively connected through the first water division chamber 51 and second water division chamber 52, there are watering hole 241 disposed on the cover 24 of the second watering chamber 54, said watering hole 241 are plurality of evenly distributed holes, so the passing water stream would flow out of said watering hole 241 and generates a flower watering.

A handle 242 is disposed on the cover 24, the supporting seat 22, the tilted member 23 and cover 24 can be conveniently rotated by the holding of said handle 242.

The impeller 31 is accommodated inside said first watering chamber 53, it comprising impeller blades 311 and impeller shaft 312, the top of said impeller shaft 312 goes through the tilted member 23, the supporting seat 22, orientation watering plate 21 and shower housing sequentially then fixed on the top rotating cover 32, the bottom of said impeller shaft 312 is fixed on the bottom rotating cover 33 by the cover plate 34. Said bottom rotating cover 33 is disposed with an off-center outlet 331. The impeller shaft 312 has a hollow chamber 313 set between the impeller blades 311 and through the off-center outlet 331 of said bottom rotating cover 33.

When the user rotates said supporting seat 22, tilted member 23 and cover 24, the two orientation watering holes 211 of the orientation watering plate 21 will superpose the first water division hole 221, then the first water division chamber 51 is fully filled with water, the water stream 60 flows into the first watering chamber 53 through the tilted hole 231 of the tilted member 23 and strikes the impeller blades 311 of the impeller 31, then the impeller 31 rotates and drives the top and bottom rotating covers rotate simultaneously, meanwhile, the water stream rotably sprays from the off-center outlet 331 of the bottom rotating cover 33 through the hollow chamber 313 between the impeller blades 311, so a spray watering is generated; when rotating the supporting seat 22, the tilted member 23 and the cover 24, the two orientation watering holes 311 of the orientation watering plate 31 will superpose the second water division hole 222, the second water division chamber 52 is fully filled with water, the water stream 60 flows to the second watering chamber 54 through the watering holes 232 of the second water division 52, and then flows out of the watering hole 241 of the cover 24, so as to generate a flower watering.

Second Embodiment

Figure 8:
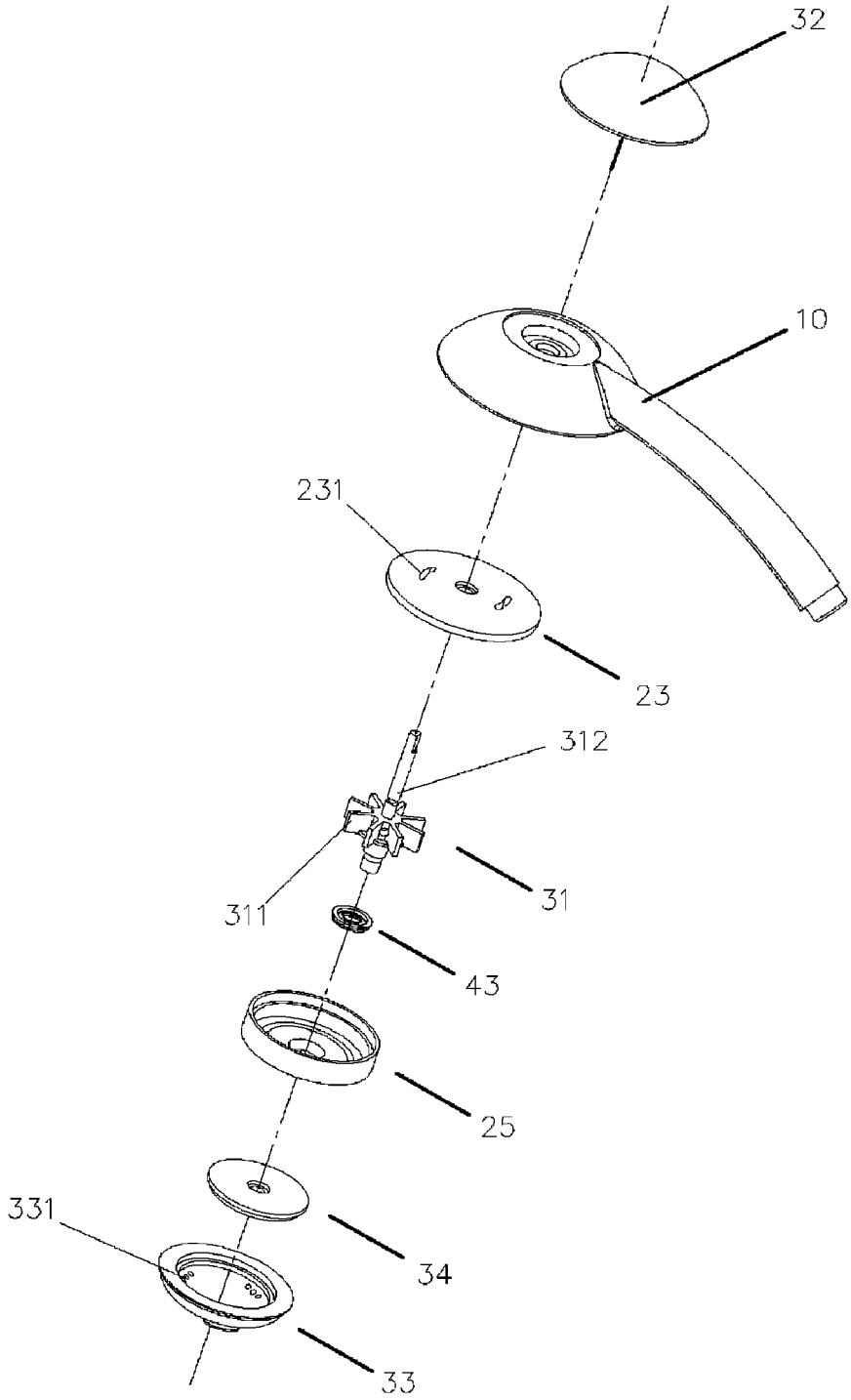
FIG. 8 illustrates the exploded view of the second embodiment of the present invention.

Please refer to FIG. 8, the shower with rotatable top and bottom rotating covers of the present invention, comprising a shower housing 10, a tilted member 23, an accommodation member 25, an impeller 31, a top rotating cover 32, a bottom rotating cover 33, a cover plate 34 and a sealing ring 43. Said tilted member 23 is disposed with two tilted holes 231 with the same tilted direction, and the tilted member 23 is jointed with the shower housing 10 and forms a chamber with it, so the water from the shower housing 10 can only flows from the tilted hole 231, said tilted member 23 and accommodation member 25 form a accommodation chamber, and the accommodation member 25 is fixed on the shower housing 10; the impeller 31 is set inside said accommodation chamber, it comprising impeller blades 311 and a impeller shaft 312. The top of the impeller shaft 312 goes through the tilted member 23, the shower housing 10 sequentially and then connected with the top rotating cover 32, the bottom of the impeller shaft 312 goes through the accommodation member 25 and then fixed on the bottom rotating cover 33 by the cover plate 34. Said bottom rotating cover 33 is disposed with an off-center outlet 331.

When the user uses the present shower, the water stream flows from the tilted hole 231 of the tilted member 23 and strikes the impeller blades 311 of the impeller 31, then the impeller 31 will rotate to drive the top rotating cover 32 and bottom rotating cover 33 rotate around a same axis, the water stream will rotably spray from the off-center outlet 331 of the bottom rotating cover 33 to generate a spray watering, because the top and bottom rotating cover 32,33 are located by the outside of the present shower, so they can rotate in accordance with the water stream, thus acquires a dramatic watering function and a better visual effect.

Third Embodiment

The essential principle and structure of the present embodiment are the same with the first embodiment, the difference lies in that: there is a illuminant unit 70 disposed on the top and bottom rotating covers, said illuminant unit 70 can be motivated by hydroelectricity power or a colorful LED motivated by a battery and so on, the top and bottom rotating covers can rotate with the impeller and then generate a glaring lighting effect, which acquires a dramatic watering function and better visual effect.

Although the present invention has been described with reference to the preferred embodiments thereof for carrying out the invention, it is apparent to those skilled in the art that a variety of modifications and changes may be made without departing from the scope of the present invention which is intended to be defined by the appended claims.

What is claimed is:

1. A shower, comprising:

a shower housing;

a watering unit which includes a tilted hole, and including an orientation watering plate which is fixed on said shower housing, said orientation watering plate and said shower housing forming a chamber, an orientation watering hole being set on said chamber, and a water division unit which is rotatably connected to said shower housing;

an impeller set beneath said tilted hole, said impeller being axially located between said shower housing and said watering unit;

a protruding top rotating cover on said shower housing and being fixed on a top of said impeller; and a protruding bottom rotating cover under said watering unit and being fixed beneath said impeller, said top and bottom rotating covers rotating along with said impeller around a same axis, said bottom rotating cover having an off-center outlet.

2. The shower according to claim 1, wherein there are two opposite orientation watering holes.

3. The shower according to claim 1, wherein said water division unit comprises a supporting seat, a tilted member and a cover sequentially connected with each other, said supporting seat being rotably supported on said shower housing, said supporting seat having a first and a second water division hole which can respectively superpose said orientation watering hole when said water division unit rotates, said first water division hole forming a first water division chamber with said tilted member, said second water division hole forming a second water division chamber with said tilted member, said tilted hole being disposed on said tilted member which is inside said first water division chamber.

4. The shower according to claim 3, wherein there are respectively two opposite first water division holes and second water division holes.

5. The shower according to claim 3, wherein said tilted member and said cover constitute a first watering chamber and a second watering chamber which are respectively connected through said first and second water division chambers, an outlet hole being disposed on said cover inside said second watering chamber; said impeller being accommodated in said first watering chamber.

6. The shower according to claim 1, wherein said impeller comprises impeller blades and an impeller shaft, said impeller shaft having a hollow chamber between the impeller blades and said hollow chamber being in communication with the off-center outlet of said bottom rotating cover.

7. The shower according to claim 6, wherein said bottom rotating cover is fixed under said impeller shaft by a cover plate.

8. The shower according to claim 1, wherein said top rotating cover is provided with an illuminant unit.

9. The shower according to claim 5, wherein said impeller comprises impeller blades and an impeller shaft, said impeller shaft having a hollow chamber between the impeller blades and said hollow chamber being in communication with the off-center outlet of said bottom rotating cover.

10. The shower with according to claim 9, wherein said bottom rotating cover is fixed under said impeller shaft by a cover plate.

* * * * *